United States Patent [19]

Leifeld

[11] 3,964,860

[45] June 22, 1976

[54] METHOD FOR DYEING CARPETS AND THE LIKE

[75] Inventor: Ferdinand Leifeld, Kempen, Germany

[73] Assignee: Eduard Kusters, Krefeld, Germany

[22] Filed: Jan. 31, 1974

[21] Appl. No.: 438,333

[30] Foreign Application Priority Data

Dec. 11, 1973 Germany ..... 2361517

[52] U.S. Cl. ..... 8/151; 68/203; 68/205 R; 118/325

[51] Int. Cl.[2] ..... D06B 11/00

[58] Field of Search ..... 8/149, 151; 68/202, 68/203, 205 R, 183; 118/324, 325, DIG. 4, 204, 211

[56] References Cited

UNITED STATES PATENTS

| | | | |
|---|---|---|---|
| 3,293,063 | 12/1966 | Pohl et al. | 118/324 X |
| 3,570,275 | 3/1971 | Weber et al. | 68/183 X |
| 3,683,649 | 8/1972 | Takriti et al. | 68/205 R X |
| 3,718,427 | 2/1973 | Ahrweiler | 68/205 R X |

*Primary Examiner*—Robert W. Jenkins
*Assistant Examiner*—Philip R. Coe
*Attorney, Agent, or Firm*—Kenyon & Kenyon Reilly Carr & Chapin

[57] ABSTRACT

An improved method of dyeing carpets and the like and apparatus for carrying out the method in which a dye film of a width equal to that of the carpet is formed and then interrupted in a varying manner to result in strips of dye being deposited on the carpet in a random fashion to obtain a visually pleasing effect.

10 Claims, 8 Drawing Figures

METHOD FOR DYEING CARPETS AND THE LIKE

BACKGROUND OF THE INVENTION

This invention relates to the dyeing of textiles such as carpets and the like in general, and more particularly to an improved method of dyeing such textiles such as to provide random patterns on the textile through control of the dye application.

It has been recognized that carpets and the like, dyed with a single color with varying tone patterns can provide a quite desirable visual effect. Such carpets can be particularly attractive when the color tone variations thereon have an apparently randomly varying effect. This type of carpet dyeing has been commonly designated as "space dyeing." One method and an apparatus for carrying out such space dyeing is disclosed in U.S. Pat. No. 3,683,649. In the apparatus disclosed therein, a roller is emersed in a trough of dye and rotated therein to pick up a film of dye. The film of dye on the roller is scraped off by a downwardly inclined doctor blade which is formed with channels so that the scraped off dye film leaves the doctor blade in a plurality of individual jets. The carpet to be dyed is moved below the jets with a grid or the like placed between the jets and the carpet and the grid being provided with an oscillating or continual lateral motion. The result is that the streams or individual jets are broken up by the grid to form a large plurality of droplets. Furthermore, it is disclosed that the V-shaped channels may be mounted for oscillation back and forth. As a result, the two oscillation patterns are superimposed upon each other to result in various amounts of dye being dropped on the carpet to achieve an apparently random pattern. A further example of this type of apparatus is disclosed in U.S. Pat. No. 3,731,503.

Although these previous methods and apparatus associated therewith have operated quite satisfactorily, there is a continuing requirement for increased variation in the types of patterns in which carpets and the like are made and thus, there is a need for improved methods which permit even greater variation than is possible in these prior art devices.

SUMMARY OF THE INVENTION

The method of the present invention provides an improved means of obtaining tone variations when dyeing a carpet or the like, which method can be used alone or in combination with the method and apparatus disclosed in the above referenced patents. The method of the present invention essentially comprises forming a dye film of a width equal to that of the carpet being dyed which, if nothing further was done, would be allowed to be deposited evenly on a carpet or other textile being dyed. Such may be done by operating a roller in the trough to pick up a film which is then scraped off by a doctor blade or may be done by any other conventional means of depositing a flowing film on an inclined doctor blade, plane or the like. Rather than permit this film to be evenly deposited on the carpet being dyed, portions thereof are interrupted in some manner so that only in certain areas is the dye allowed to flow off the doctor blade. Preferably, the interrupting is done in an oscillating manner so that a variation in the portions of the blade from which the dye is dropped varies with time.

In one disclosed embodiment of an apparatus for carrying out the invention, a film picked up by a roller rotating in a trough has a plurality of blades on its rear side to scrape off dye in selected areas before the dye film reaches the doctor blade from which it flows onto the carpet. The plurality of scraping blades are mounted for oscillating motion so that a variation in the portions of the blade from which the dye drops is obtained. In a second embodiment similar to the first embodiment, the auxiliary scraping blades are placed in contact with the surface of the doctor blade to result in a re-distribution of the dye thereon. That is, the dye meeting the scraping blade will flow off this blade to either side thereof, resulting in portions with no dye and other portions with a heavier than normal dye flow on each side of the scraping blade. Again, the scraping blades will preferably be oscillated.

In another disclosed embodiment, the roller in the trough has a plurality of brushes, mounted on the rear side thereof, brushing off the portions of the dye film formed thereon. In this embodiment, the dye is transferred from the roller operating in the trough to a second transfer roller which picks up the film and then transfers it to the textile which runs between this transfer roller and a further roller. In a further embodiment, pouring means for pouring the dye over the doctor blade are shown in conjunction with a plurality of air jets means which direct air streams onto the doctor blade to result in dispersion of the dye film away from the areas having air directed thereon to achieve a result similar to that in the apparatus where scraper blades are placed on the surface of the doctor blade. Finally, an embodiment of the present invention in combination with the type of apparatus disclosed in the aforementioned patents is shown. In this type of operation, the scraper blades or other means operate as described above with the dye film from the doctor blade then being directed into channels formed thereon, resulting in a plurality of jets which vary as the scraper blades are oscillated back and forth. In addition, the grid disclosed in the aforementioned patents is interposed between the jets of dye and the carpet being dyed. Also shown is an arrangement in which a plurality of devices are arranged in series. Examples are given giving typical operating parameters and illustrating the type of finished product which can be obtained from the method of the present invention.

DETAILED DESCRIPTION OF THE PREFERRED EMBODIMENT

Figure 1:
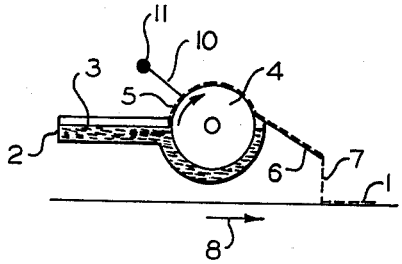
FIG. 1 is a schematic elevation view, partially in section of a first embodiment of the present invention using scraper blades placed at the rear of the roller in the trough.
Figure 2:
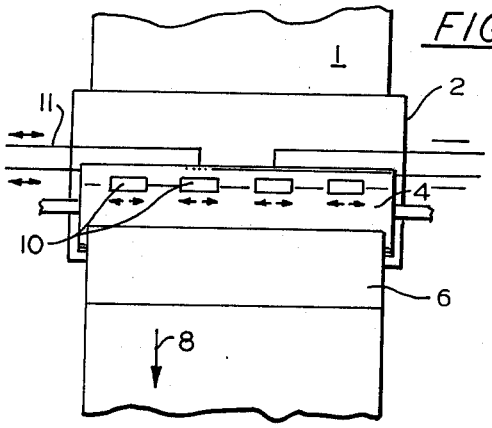
FIG. 2 is a plan view of the embodiment of FIG. 1.

The basic method of the present invention can be described in reference to FIGS. 1 and 2. Shown thereon is a trough 2 containing a dye 3. Rotating within the trough 5 is a roller 4 which picks up a film 5 of dye. The film 5 is carried with the roller 4 in the direction of the arrow and is scraped off the roller by means of an inclined doctor blade 6. Thus, the doctor blade 6 will have thereon a film 7 of dye which will drop off onto a carpet or the like 1 which is being moved below the doctor blade in the direction of the arrow 8. As in the prior art, the textile or carpet 1 will have been previously pad dyed with a solid color and the dye pressed out. Were nothing further done, an even film of dye would be deposited on the carpet 1. However, a plurality of liquid retarding means in the form of scraper blades 10 are placed on the rear of the roller 4. Each of these blades 10 is mounted to a movable support rod or the like 11 which is then coupled to appropriate means for obtaining oscillatory motion. A scraper blade, which has a width less than that of blade 6, will scrape the dye film 5 off the roller 4 in the area in which it is situated returning the scraped off dye to the trough 2. The result will be that strips of dye are deposited on the carpet 1. Because of the oscillatory motion of the scrapers 10, these strips will contain random variations. As will be more fully described below, the variations obtained in this manner can be combined with a channeled doctor blade and grid apparatus known in the prior art to obtain still greater variations in the final product.

Figure 3:
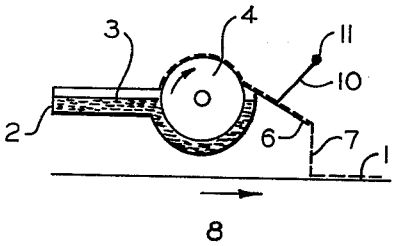
FIG. 3 is a schematic elevation view partially in cross-section of a second embodiment of the invention in which scraper blades are located on the doctor blade.
Figure 4:
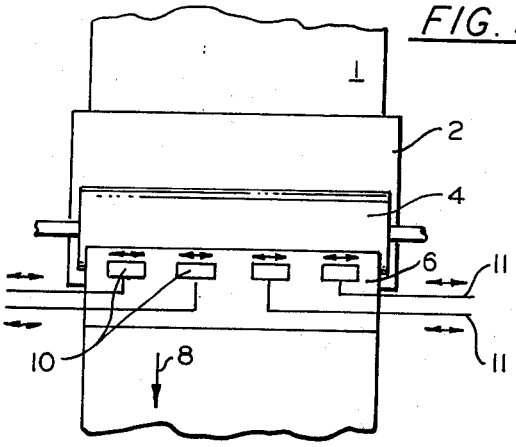
FIG. 4 is a plan view of the embodiment of FIG. 3.

FIGS. 3 and 4 illustrate a second apparatus for carrying out the method of the present invention. Identical parts are given identical reference numerals. The main difference in this embodiment is that the scraper blades 10 are now placed so as to contact the surface of the doctor blade 6. As before, they are mounted to rods or the like 11 which are mounted for oscillatory motion. The scraper blades 10 will cause the dye film 7 with which they come in contact to be directed to each side thereof so that at the portions where the blades are present essentially no dye will flow from the doctor blade 6 but in areas immediately adjacent scraper blades 10 an increased amount of dye will flow. Again, this will result in strips of dye being deposited on the carpet. These strips will vary as the scraper blades 10 are oscillated back and forth. In both the embodiments above described and as will be seen in more detail in connection with FIG. 7, the scraper blades 10 need not be moved in unison and need not maintain their relative positions. That is, they may be moved randomly and may cross each other if desired. Also as with the embodiment of FIGS. 1 and 2, the embodiment of FIGS. 3 and 4 may be combined with a channeled doctor blade and/or grid arrangement.

Figure 5:
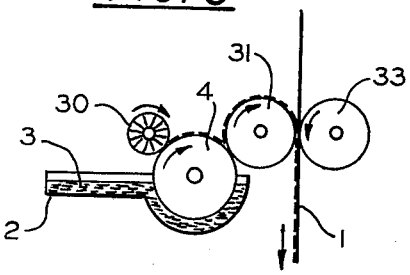
FIG. 5 is a schematic elevation view, partially in cross section of a further embodiment of the invention in which brushes are used on the rear part of the roller to remove dye therefrom and the remaining dye transferred by another roller to the material being dyed.

FIG. 5 illustrates a further apparatus for carrying out the method of the present invention. Again, like parts are given like reference numerals. In this embodiment, the carpet or other textile to be dyed designated 1 is driven in the direction of the arrow between two rollers 31 and 33. In place of the scraper blades 11 of the previous embodiments, a plurality of brushes 30 are mounted at the rear of the roller 4 for brushing off portions of the dye film therefrom. The dye film remaining as the roller 4 rotates in the direction of the arrow is picked up by the transfer roller 31 and then deposited on the textile 1. Each brush will be mounted for individual positioning parallel to the axis of roller 4.

Figure 6:
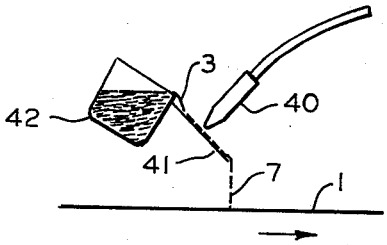
FIG. 6 is a schematic elevation view partially in cross section illustrating a further embodiment of the invention using a different type of film forming means along with air jets for interrupting the film.

A further embodiment of the invention is illustrated by FIG. 6. Here, the dye 3 is poured from a container 42 to form a film 7 on the doctor blade 41. This embodiment illustrates that the method of the present invention can be carried out not only with rollers such as the roller 4 in the previous embodiments, but with any type of apparatus which can form a film on a doctor blade or the like. The film so formed on the inclined blade 41 is disrupted by an air stream from an air jet 40 illustrating a further type of interrupting means. The result will be essentially the same as that disclosed in connection with FIGS. 3 and 4 with the dye beneath the air stream being directed in the sides thereof so that in the areas below the air stream essentially no dye will be deposited and in the area between air jets, heavier strips of dye will be deposited. As in the previous embodiments, a plurality of air jets 40 will be mounted for oscillatory motion.

Thus, in each of the above-described embodiments, means are provided to form a dye film on an inclined plane such as a doctor blade, means provided to insure that the dye film so formed leaves the plane in the form of strips, the means being such as to interrupt a portion of dye from the film forming means or from the blade itself, and furthermore that the means for interrupting the dye are adapted for oscillatory motion so that the strips will move randomly.

Figure 7:
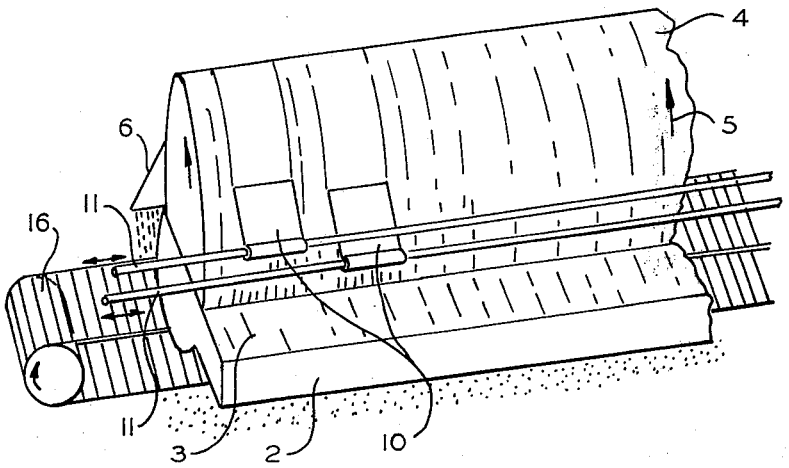
FIG. 7 is a perspective view of the embodiment of FIG. 1 in combination with a prior art type system including a moving grid.

A preferred embodiment of the invention is shown in the perspective view of FIG. 7. The embodiment shown thereon corresponds to the embodiment of FIG. 1 in combination with previously known methods of accomplishing such dyeing. In the manner described above in connection with FIGS. 1 and 2, a roller 4 rotates within a trough 2 containing a supply of dye so that a film 5 of dye is formed thereon as the roller rotates in the direction of the arrows. The scraper blades 10 are in contact with the surface of the roller 4 at the rear and selectively scrape off portions of the dye film 5 and cause it to return to the trough 2. In the manner described above, the dye is then scraped off the front of the roller 4 by a doctor blade 6 and flows down the doctor blade dropping off to the carpet below. Interposed between the carpet 1 and the doctor blade 6 is a grid 16 mounted on rollers for oscillating or continuous motion in the manner described in the above referenced patents. The doctor blade 6 may be a plane flat surface or may be channeled in the manner of the prior art as will be more fully described below in connection with FIG. 8. In any case, the droplets or film of dye flowing off the doctor blade 6 will be acted upon by the grid 16 causing them to be broken up and to create a random pattern when finally deposited on the material 1.

Note that the scraper blades 10 are located in different horizontal planes and each is separately mounted to a rod 11 which, as above mentioned, is coupled to means to provide back and forth motion as illustrated by the double arrows associated therewith. This permits control of the blades such that overlap to provide wider strips is possible and even permits blades to cross each other. Although only two scrapers 10 are shown, it will be recognized that a greater plurality spaced across the roller will be used. The rods 11 may be driven by the type of apparatus disclosed in U.S. Pat. No. 3,683,649.

Figure 8:
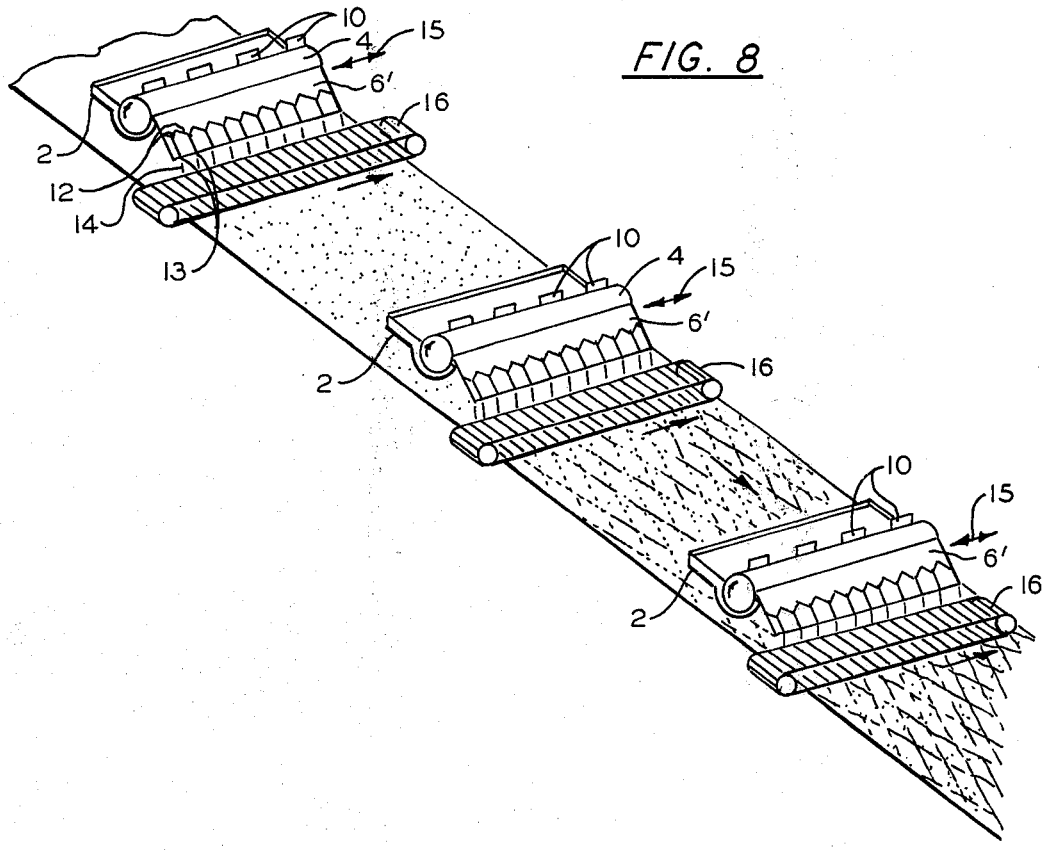
FIG. 8 is a perspective view illustrating a plurality of arrangements such as that of FIG. 7 arranged in series fashion to contribute in an additive manner to the final pattern on the carpet or other material.

FIG. 8 illustrates a number of devices such as that of FIG. 7 arranged in serial fashion, each depositing dye on a carpet 1 or the like to end up with a final desired pattern. Also more fully illustrated in connection with FIG. 8, is a doctor blade 6′ of the type disclosed in the above identified patents which contains a plurality of sections 12 forming channels 13 from which jets or streams of dye 14 fall. As in the prior art devices, the doctor blade designated 6′ is mounted for back and forth motion to add further variation to the pattern deposited on the carpet. It will be recognized that the system shown on FIG. 8 provides a great number of variables which can be used in achieving different effects. These include the speed of movement of the carpet or textile 1, the speed of rotation of the rollers 4 which determines the amount of dye which they pick up and deposit on the doctor blade per unit time, the size, placement and movement of the scraper blades 10, the movement of the doctor blade 6′ and the movement of the grid 16. In particular, it is worthwhile to consider the combined effect of the scraper blades 10 along with the doctor blade 6′ and the grid 16. As the scraper blades are moved back and forth, in some positions, some of the channels 13 will receive no dye, in other positions the amount of dye they receive will vary and in still further positions, they will receive the full amount of dye. A combination of the control of strips of dye on the roller 4 in conjunction with the effect of the channels 13 will result in an increased variation in the amount of dye deposited on the carpet. Thus, the amount of dye flowing out of any of the streams or jets 14 will be continuously varying from the full amount to nothing as a function of the placement and movement of the scraper blades 10. These streams are then acted upon by the grid 16 in the manner of the prior art to further break them up into pluralities of droplets. These plurality of droplets will be lighter and heavier as opposed to the prior art arrangement where all drops were more or less the same. Thus, an added dimension is provided in the capability of dyeing carpets and the like with random patterns. As shown by FIG. 8, there are three such devices in series with each other, each contributing to the overall pattern on the carpet. In each, the various control parameters may be varied to end up with superimposed patterns to result in a final product which is extremely attractive to the eye. Each device may deposit dye of a different or of the same color.

These various patterns can best be understood by three typical patterns obtainable using the method and apparatus of the present invention. The table below sets out the parameters used in operating the apparatus of the present invention to obtain these patterns.

| Test No. | Test 1 | Test 2 | Test 3 |
|---|---|---|---|
| Speed of travel of textile material (m/min) | 6.5 | 6.5 | 6.5 |
| Tangential velocity of roll 4 (m/min) | 1.0 | 9.2 | 9.2 |
| Stroke of blades 10 (mm) | 400 | 400 | 50 |
| Width of blades 10/unscrapped width (mm) | 100/100 | 100/100 | 100/100 |
| Oscillation frequency of blades 10(Hz) | 0.25 | 0.2 | 0.2 |
| Point of contact of blades 10 as measured from a tangential plane (mm) | 5 | 5 | 5 |
| Stroke of doctor blade 6 (mm) | 25 | 25 | 10 |

-continued

| Test No. | Test 1 | Test 2 | Test 3 |
|---|---|---|---|
| Spacing of channels 13 on doctor blade 6 (mm) | 22 | 22 | 22 |
| Oscillation frequency of doctor blade (Hz) | 1 | 2.5 | 2.5 |
| Linear speed of grid 16 (m/min) | 0.2 | 0.2 | 0.2 |
| viscosity of dye (sek/ $\phi$ mm) | 55/4 | 105/3 | 105/3 |

These are results obtainable with a single device such as that of FIG. 8. The dye used was formulated as follows:

The following was added per liter water:

4 grams Irgapadol P ch 35/56 (Ciba-Geigy)

10 grams acetic acid 16 grams acid dye in powder form Tectylon (Ciba-Geigy)

Approx. 10 grams ether derivative from the flour of the kernals of St. John's bread (dry substance) as thickner. The exact amount differed in accordance with the natural product. Thus, the amount required for the desired viscosity given in the above table was added.

The point of contact measurement given above is determined as follows: From a tangential plane (to roller 4) the distance e.g. 5 mm, is measured to establish a second plane parallel thereto. The blades contact the surface at the intersection of this second plane with roller 4.

Thus, an improved method and apparatus for dyeing carpets and the like to produce random aesthetically pleasing patterns thereon using a single dye color with tonal variation has been shown. Although specific steps of the method and specific embodiments for carrying it out have been illustrated and described, it will be obvious to those skilled in the art that various modifications may be made without departing from the spirit of the invention which is intended to be limited solely by the appended claims.

What is claimed is:

1. A method of dyeing textile materials such as a carpet so as to form random patterns thereon comprising the steps of:

a. rotating a roller in a trough of dye to form a dye film of width equal to that of the material for deposit onto the material;

b. placing a doctor blade in the form of an inclined plate in contact with said roller whereby said dye film of a width equal to the material width will be transferred to said inclined doctor blade;

c. continuously applying scraper blades to the surface of one of said roller and said doctor blade to alter the film thereon;

d. continuously varying the transverse position of said scraper blades with respect to time so as to form continuous strips varying amounts of dye which vary across the material width with respect to time; and e. depositing the strips so formed on the textile material by permitting said strips to flow off said inclined plate and fall on material moving therebelow.

2. The method according to claim 1 and further including the step of interposing a grid to break up said film between said plane and said textile.

3. The method according to claim 1 wherein said step of interrupting said film is carried out so as to further cause a variation in the width of said strips with respect to time.

4. The method according to claim 1 wherein said step of interrupting is carried out so as to vary the placement of said strips with respect to time.

5. The method according to claim 1 and further including the step of directing the film on said inclined plane into a plurality of channels to form jets of dye dropping off said inclined plane.

6. The method according to claim 1 wherein said step of interrupting comprises placing scraper blades on the surfaces of said doctor blade to redirect the flow of the film of dye thereon.

7. A method of dyeing textile material comprising performing the method of claim 1 a plurality of time in succession on each portion of the textile material.

8. A method of dyeing textile materials such as a carpet so as to form random patterns thereon comprising the steps of:

a. rotating a roller in a trough of dye to form a dye film of width equal to that of the material for deposit onto the material;

b. placing a doctor blade in the form of an inclined plate in contact with said roller whereby said dye film of a width equal to the material width will be transferred to said inclined doctor blade;

c. applying scraper blades to the surface of said roller to alter the film thereon before said roller is contacted by said doctor blade;

d. varying the transverse position of said scraper blades with respect to time so as to form strips of varying amounts of dye which vary across the material width with respect to time; and e. depositing the strips so formed on the textile material by permitting said strips to flow off said inclined plate and fall on material moving therebelow.

9. A method of dyeing textile material such as carpet so as to form random patterns thereon, comprising the steps of:

a. forming a dye film of a width equal to the material width for deposit onto the textile material by passing a first roller through a trough of dye;

b. transferring the film of dye from said first roller to a second roller;

c. selectively interrupting said film on said second roller by selectively removing dye from said first roller so as to form a film which contains across its width strips of varying amounts of dye;

d. varying the transverse position of the strips so formed across the material width with respect to time; and e. depositing the strips so formed on the textile material by bringing said second roller into contact with said material whereby said dye will be transferred from the surface of said first roller to said material.

10. A method of dyeing textile material such as a carpet so as to form random patterns thereon, comprising the steps of:

a. forming a dye film, of a width equal to the material width for deposit onto the textile material, on an inclined plate;

b. selectively interrupting said film by directing a plurality of air blasts on the surface of said plate so as to form a film which contains across its width strips of varying amounts of dye;

c. varying the transverse positions of said strips so formed across the material width with respect to time by moving said air blasts transversly to the direction of material motion; and d. depositing the strips so formed on the textile material.

* * * * *